US007540103B2

(12) United States Patent
Broten

(10) Patent No.: US 7,540,103 B2
(45) Date of Patent: Jun. 2, 2009

(54) BLADE ATTACHMENT DEVICE

(76) Inventor: James O. Broten, 1637 106th Ave. SE., Dazey, ND (US) 58429

( * ) Notice: Subject to any disclaimer, the term of this patent is extended or adjusted under 35 U.S.C. 154(b) by 0 days.

(21) Appl. No.: 11/801,800

(22) Filed: May 11, 2007

(65) Prior Publication Data

US 2008/0276499 A1 Nov. 13, 2008

(51) Int. Cl.
*E01H 5/06* (2006.01)
*E02F 3/00* (2006.01)

(52) U.S. Cl. ..... 37/276; 37/231; 37/280; 37/266; 172/786; 172/445.2

(58) Field of Classification Search ..... 37/263, 37/266, 276, 273, 274, 279, 281, 231; 172/276, 172/815, 445.2, 272
See application file for complete search history.

(56) References Cited

U.S. PATENT DOCUMENTS 1,196,965 A * 9/1916 Moats et al. ..... 172/787
1,199,075 A * 9/1916 Hyde ..... 293/58
1,262,966 A * 4/1918 Mahon ..... 37/263
1,354,264 A * 9/1920 Miller ..... 172/786
1,498,690 A * 6/1924 Hunziker ..... 37/263
1,554,400 A * 9/1925 Bruhn ..... 172/784
1,749,465 A * 3/1930 Caskin ..... 37/232
2,582,136 A * 1/1952 Koblas ..... 37/263
2,623,310 A * 12/1952 Raught ..... 172/833
2,749,631 A * 6/1956 Thompson ..... 172/445.2
2,856,709 A * 10/1958 Brockly ..... 172/786
2,955,367 A * 10/1960 Vort ..... 37/263
3,195,249 A * 7/1965 Collins ..... 172/655
3,201,878 A * 8/1965 Markwardt ..... 37/231
3,424,251 A * 1/1969 Bouley ..... 172/810
3,425,497 A * 2/1969 Strabala et al. ..... 172/792
3,435,546 A * 4/1969 Iverson ..... 37/381
3,471,953 A * 10/1969 Wyatt ..... 37/142.5
3,598,186 A * 8/1971 Coontz ..... 172/445.2
3,657,828 A * 4/1972 Anderson ..... 37/274
3,797,582 A * 3/1974 Couch ..... 172/445.2
4,096,652 A * 6/1978 Raines et al. ..... 37/231
4,356,645 A * 11/1982 Hine et al. ..... 37/281
4,552,226 A * 11/1985 Platter ..... 172/815
4,658,519 A * 4/1987 Quenzi ..... 37/231

(Continued)

*Primary Examiner*—Thomas A Beach
(74) *Attorney, Agent, or Firm*—Robert E. Kleve

(57) ABSTRACT

The invention is related to an attachment to a front end loader. The invention comprises a dual blades having a rear frame which is fixed to the movable arm means at the front of the front end\ loader. The rear frame has a pivotal left arm and a pivotal right arm with a left blade mounting frame pivotal mounted to the forward end of the left arm and a left blade spring mounted to the forward end of the left mounting frame. A right blade mounting frame is pivotally mounted to the forward end of the right arm and a right blade spring mounted to the forward end of the right blade mounting frame. A pair of hydraulic cylinders with one mounted between the left arm and the rear frame and with the other mounted between the left arm and the left blade mounting means. A pair of hydraulic cylinders with one mounted between the right arm and the rear frame and the other mounted between the right arm and the right blade mounted means whereby the hydraulic cylinders may actuated to move the right and left blades and their associated right and left mounting blades to various angles independently of one another.

2 Claims, 10 Drawing Sheets

U.S. PATENT DOCUMENTS 4,665,636 A * 5/1987 Borras ..... 37/234
4,802,293 A * 2/1989 Smith ..... 37/381
4,866,862 A * 9/1989 Vu et al. ..... 37/233
5,427,185 A * 6/1995 Seal ..... 172/684.5
5,485,690 A * 1/1996 MacQueen ..... 37/271
5,802,746 A * 9/1998 Miller ..... 37/263
5,819,444 A * 10/1998 Desmarais ..... 37/281
5,974,702 A * 11/1999 Donoghue ..... 37/263
6,044,579 A * 4/2000 Hadler et al. ..... 37/234
6,273,637 B1 * 8/2001 Peterson ..... 404/127
6,286,236 B1 * 9/2001 Bowers ..... 37/236
6,691,435 B1 * 2/2004 Schultz et al. ..... 37/234
6,813,848 B2 * 11/2004 Ortamala ..... 37/222
6,877,258 B2 * 4/2005 Frey ..... 37/281

* cited by examiner

BLADE ATTACHMENT DEVICE

The invention comprises a trench blade attachment to a loader. The attachment invention is provided with two movable blades movable to at least five different positions by hydraulically operated pistons to perform several different functions to provide for year round operations as work attachment.

It is an object of the invention to provide two blades beside one another at the forward lifting means of a front end loader with the blades each having independently powered means to position each blade independently of the other blade to different positions from longitudutinally\\ beside one another to independently angularly to one another with controlled spacing from one another.

Further objects and advantages of the invention will become apparent as the description proceeds and when taken in conjunction with the accompanying drawings wherein:

Referring more particularly to the drawings; in

FIG. 1, the skid steer blade invention is illustrated in a side perspective view with the two blades arranged in spaced V configuration for moving heavier materials such as heavy snowdrifts or dirt piles to the side of the blade apparatus as it moves forward. The blades of the V are spaced apart with spaced V shape of the blades opening a path larger than the skid steer track and allows an opening to take smaller widths, depending upon the angle of the blades, with other options or additional passes.

Figure 1:
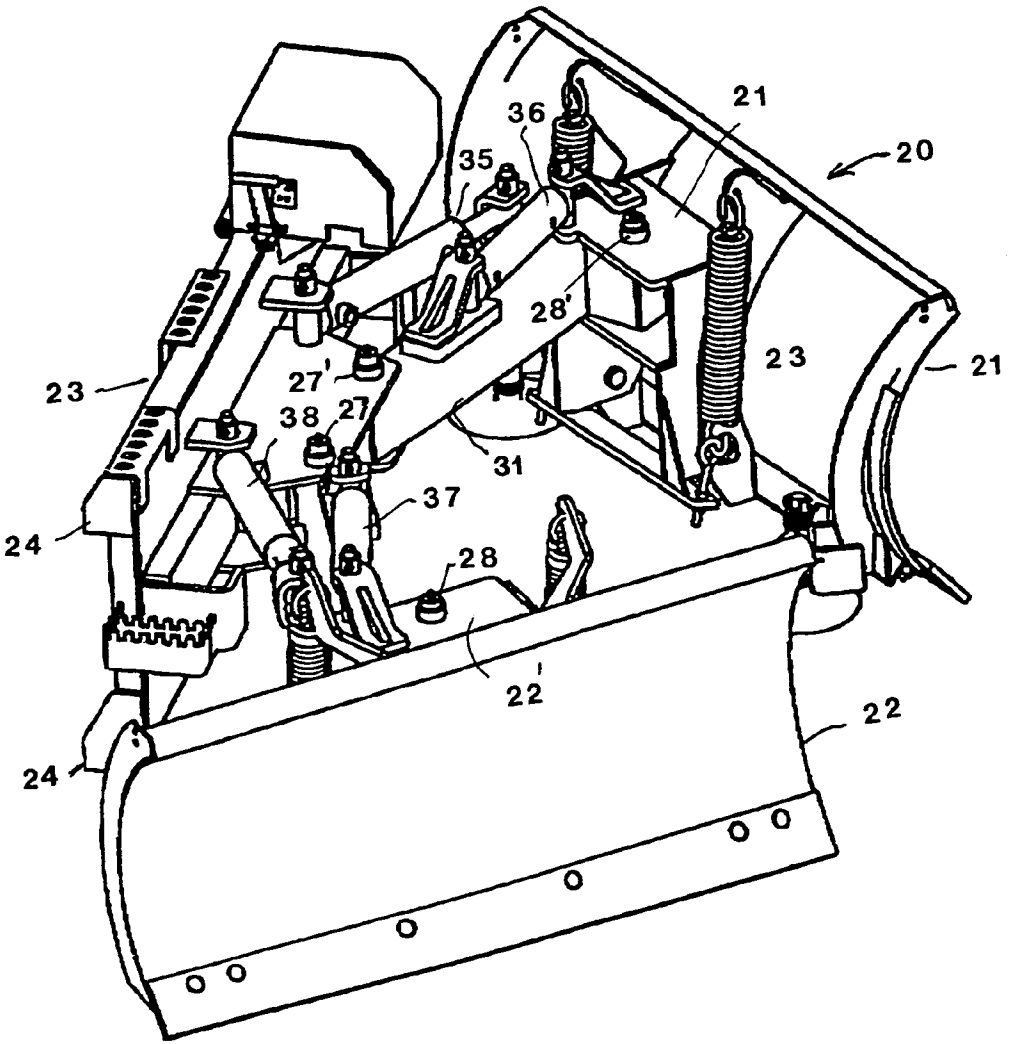
Figure 2:
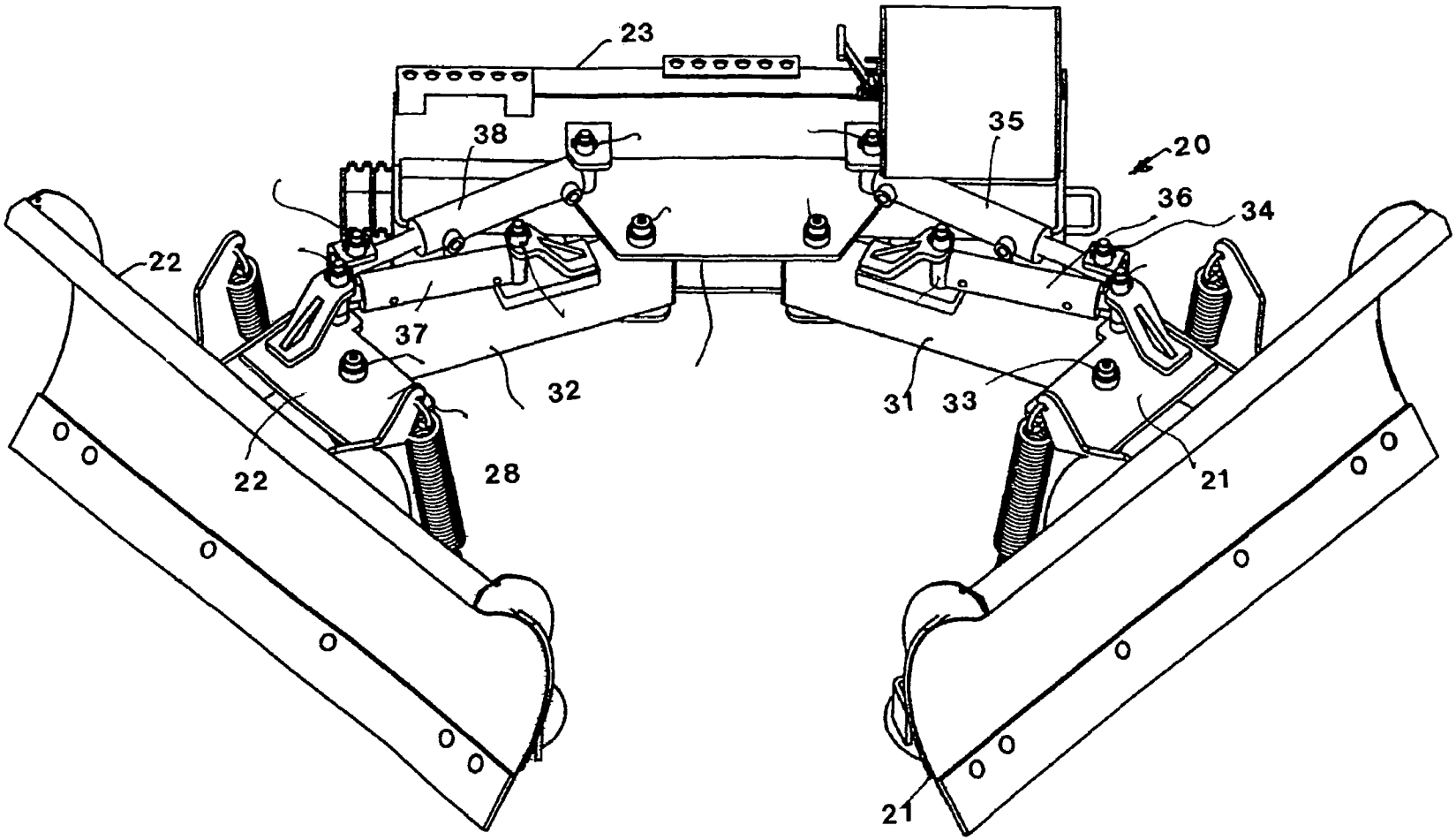
FIG. 2 is a front perspective view with the two blades arranged in the spaced V configuration.
Figure 3:
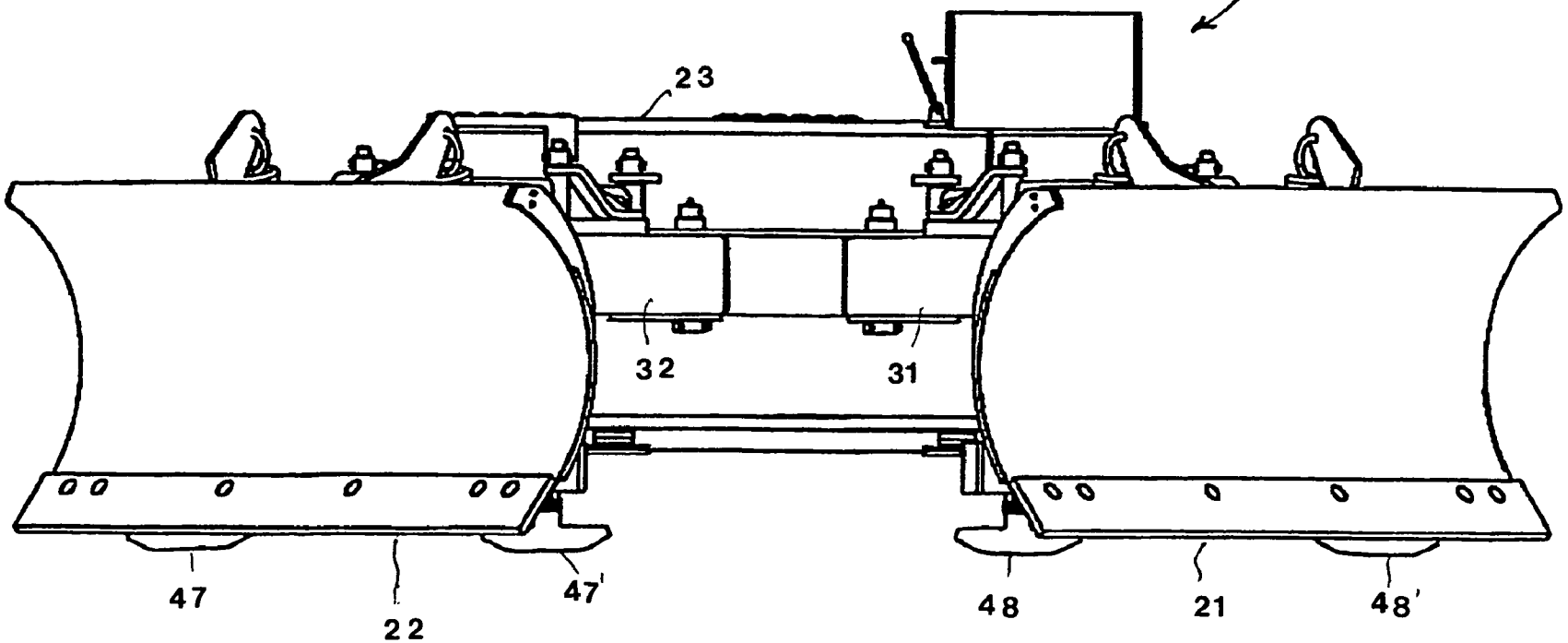
FIG. 3 is a front view with the two blades arranged in the spaced V configuration.
Figure 4:
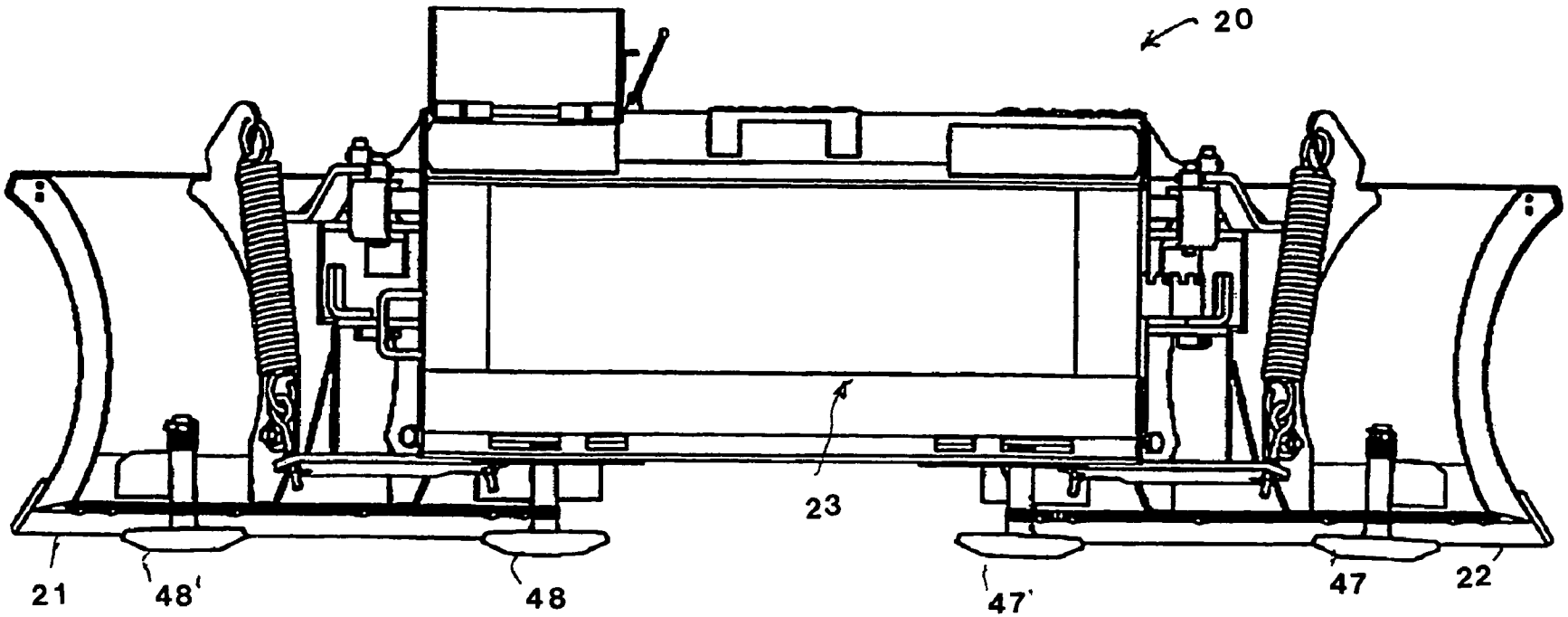
FIG. 4 is a rear view of with the two blades arranged in the spaced V configuration.

Referring more particularly to the drawings,

The steer blade attachment 20 has a pair of blades 21 and 22 and a back or rear frame 23 The rear frame has conventional brackets 24 and 24' for attachment to a conventional front end loader. The upper and lower mounting brackets 24 and 24' are engage in fixed relation to a conventional quick attachment mounted to the front of the arms of a conventional loader.

The blades 21 and 22, respectively each have a blade mounting frame 21' and 22', respectively immediately behind its respective blade. The blade 21 is mounted to its blade mounting frame 21' by a pair of springs 25 and 25'. The lower ends of springs 25 and 25' are mounted to connected to the lower end of the blade 21 by a connecting rod 26. The upper ends of the springs 25 and 25' are inserted in a apertures 27 and 27' in a plate at the top of the blade 21 so that the blade 21 is spring loaded by the springs, so that it can pivot its upper end forward and downward relative to the blade mounting frame 21', for example, to allow it to travel of obstacles when necessary to prevent less chance of damage to the blade 21.

Similarly, blade 22 has a pair of springs 28 and 28' with each having a mounting rod 29 at the lower end of each side of the blade mounting frame 22' connecting the lower ends of the springs to the lower end of the blade mounting frame on each side. The upper coiled end of the springs 28 and 28' are connected to the upper end of the blade 22 at apertures 30 and 30' so that the blade 22 is spring loaded by the springs so that the blade 22 can pivot its upper end forward and downward relative to its blade mounting frame 22', limited by the springs to, for example, allow the blade 22 to better travel over obstacles when necessary to provide less chance of damage to the blade 22.

The blades mounting frames 21' and 22', respectively, of the blades 21 and 22 of the attachment are connected to the main rear frame 23 by a pair of elongated L shaped arms 31 and 32, respectively.

The elongated arm 31 has its front end is pivotally mounted to the left blade mounting frame 21' at pivot 33 and is pivotally mounted at its rear end to the main rear frame 23 at pivot 33'. The elongated arm 32 of the right blade is pivotally mounted at its front end to the right mounting frame 22' of right blade 22 at pivot 34 and pivotally mounted at its rear end to the main rear frame at pivot 34'.

A pair of cylinders 35 and 36 control the position of the left blade 21 and a pair of cylinders 37 and 38 control position of the right blade 22. The cylinder portion 35' of cylinder 35 of the left blade is pivotally mounted to the main rear frame 23 at pivot 39. The piston portion 35" of cylinder 35 is pivotally mounted a forward portion of the left arm 31 at pivot 40. The cylinder portion 36' of cylinder 36 is pivotally mounted to the left arm 31 at pivot 41 and the piston portion 36" of cylinder 36 is pivotally mounted to the rear portion of the left blade mounting frame 21' of left blade 21 at pivot 42.

The cylinder portion 37' of cylinder 37 is pivotally mounted to right arm 32 at pivot 43 and the piston portion 37" of cylinder 37 is pivotally mounted to the right blade mounting frame 22' of the right blade 22 at pivot 44. The cylinder portion 38' of cylinder 38 is pivotally mounted to the rear main frame 23 at pivot 45 and the piston portion 38" of cylinder 38 is pivotally mounted to the right arm 32 at pivot 46.

The hydraulically actuation of the four cylinders 35,36,37, 38 act to retract or telescope their pistons enable the two blades to be positioned to the five different positions to be described and to any intermediate position thereof, including the two blade in a straight line beside one another or to a forward or reverse position to one another, at well as to be spread apart from one another at various angles. The powering of the blades to their various positions may also be powered by electrical power means as may be available.

Figure 5:
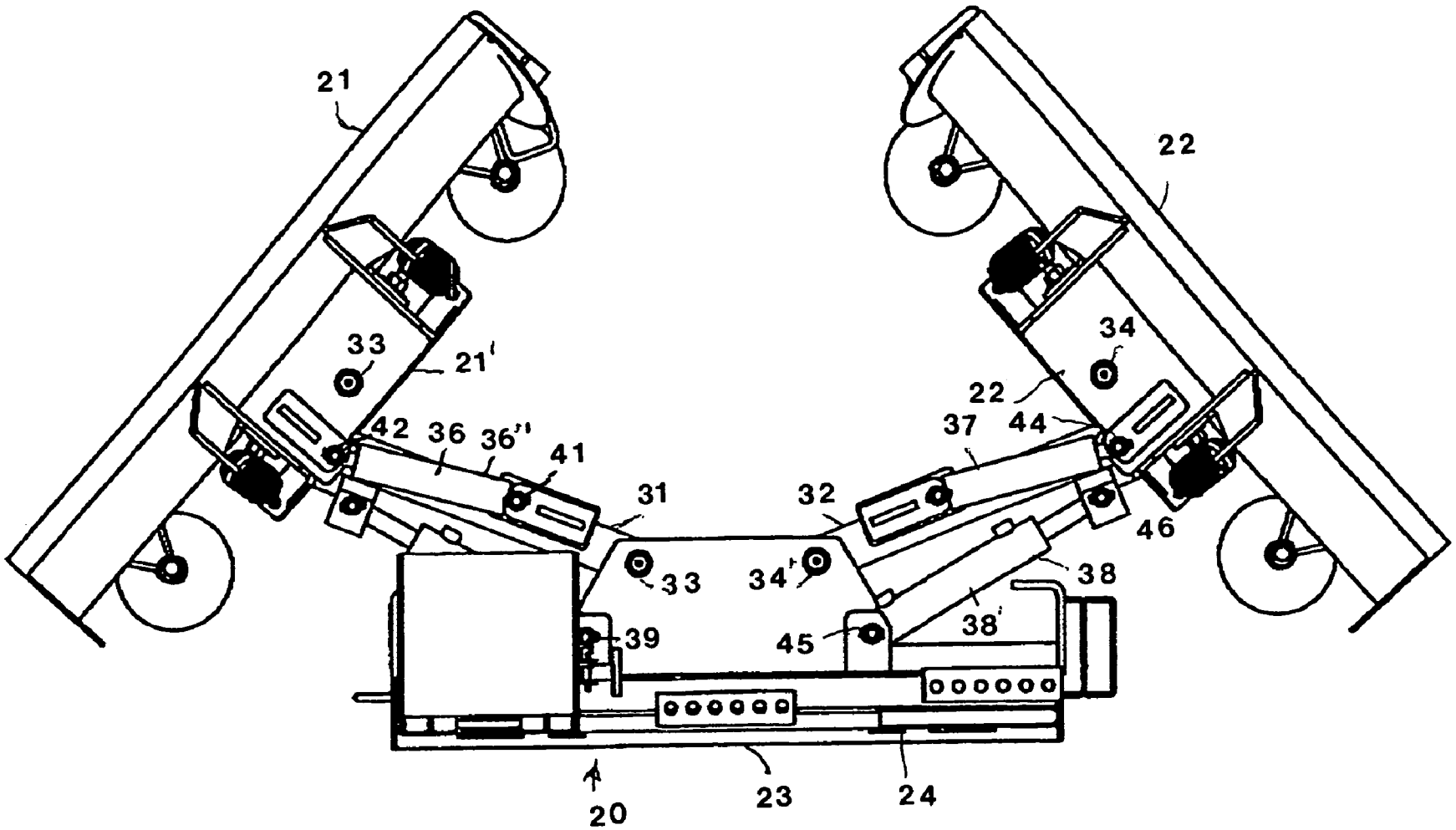
FIG. 5 is a top view with the two blades arranged in the spaced V configuration.
Figure 6:
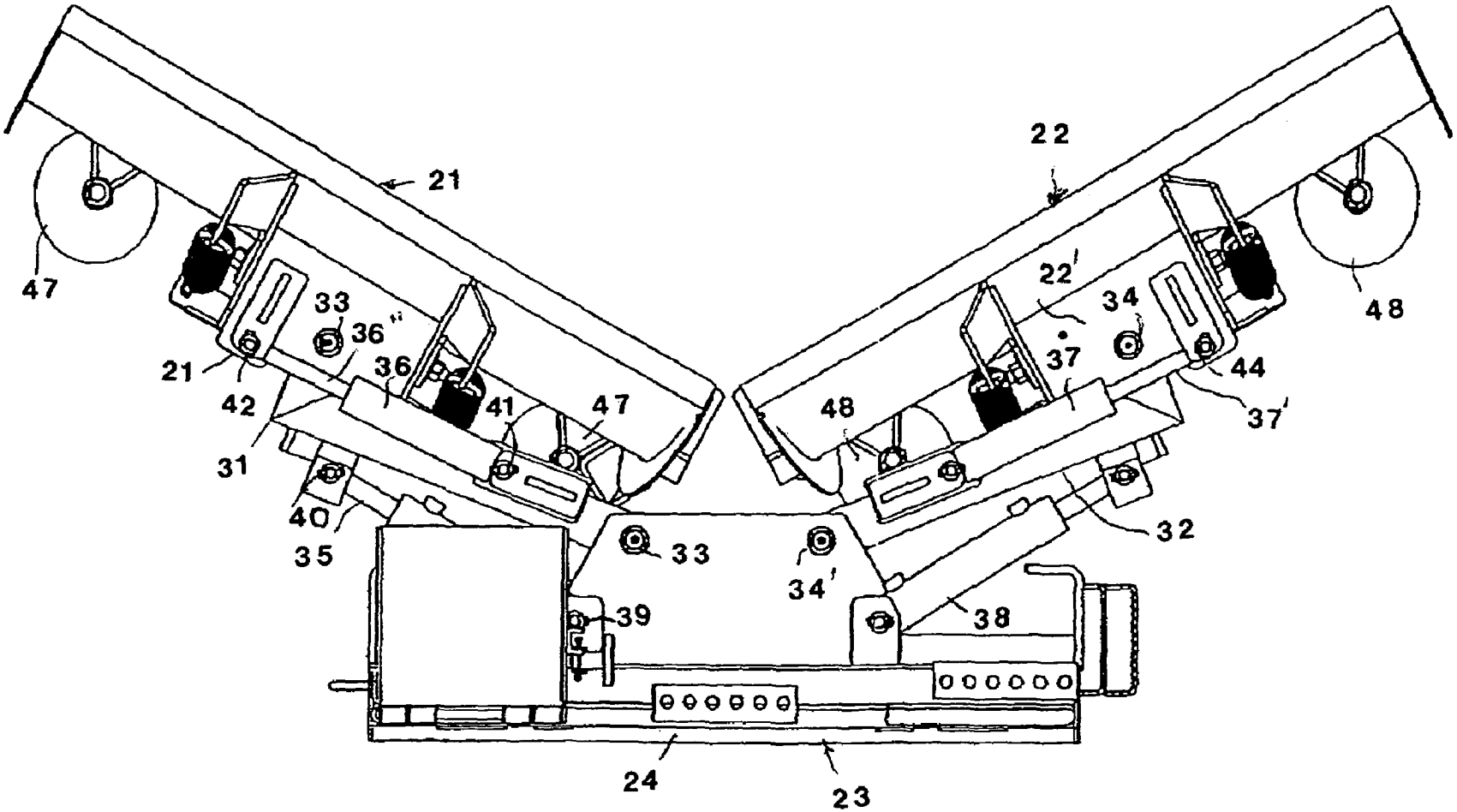
FIG. 6 is a top view with the two blades arranged in a inverted V configuration.

For example, telescoping the piston 36' of cylinder 36 from its position in FIG. 5 to its position shown in FIG. 6 pivots the left blade clockwise on the left arm 31 to its position shown in FIG. 6 relative to the left arm; while retracting the piston 35 from its position in FIG. 5 pivots the left arm and left blade about the left arm pivot 33' to the position of the left blade and left arm to their position as shown in FIG. 6

Further, telescoping of the piston 37' of cylinder 37 from its position in FIG. 5 to its shown in FIG. 6 pivots the right blade counterclockwise on the right arm 32 to its position shown in FIG. 6 relative to the right arm; while retracting the piston 38' from its position in FIG. 5 pivots the right arm 32 and right blade about the right pivot 34' to the position if the right blade and right arm to their position shown in FIG. 6.

The activation of the arms of the loader upward and downward, through their conventional quick detach connection to the main rear frame 23 upward and downward can cause the blades 21 and 22 to be pivoted upward and downward upon the rear frame, relative to the loader and the ground.

The blades 21 and 22 can be pivoted to its spaced forward convex V shaped angular position as illustrated in FIG. 1-5 by operating the pistons and cylinders for drawing materials toward one another, if desired, for operating as a snow plow to shove snow from the middle of a road to each side, for example.

The blades 21 and 22 can be pivoted to their concave position by operating the pistons and cylinders. The blades, when in their concave position shown in FIG. 6, can be used for filling or re-filling openings in the ground, sometimes referred to a trenching.

Figure 7:
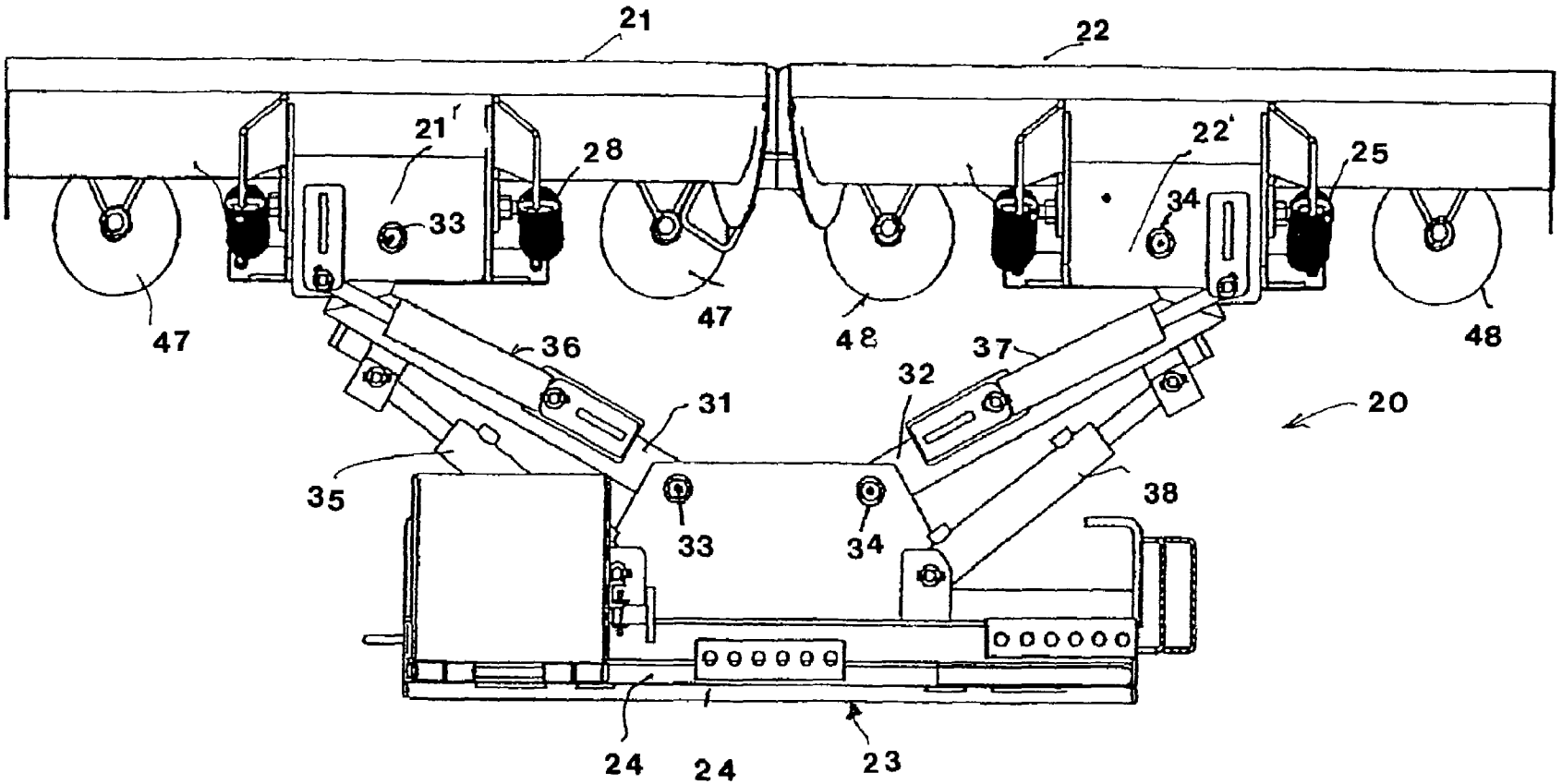
FIG. 7 illustrates the trench blade invention with the two blades arranged in straight line to one another to provide maximum width and can be used for blading when a straight push is required either when moving snow or dirt.

The blades 21 and 22 can be pivoted to a side by side straight line position for use as a straight blade as shown in FIG. 7

Figure 8:
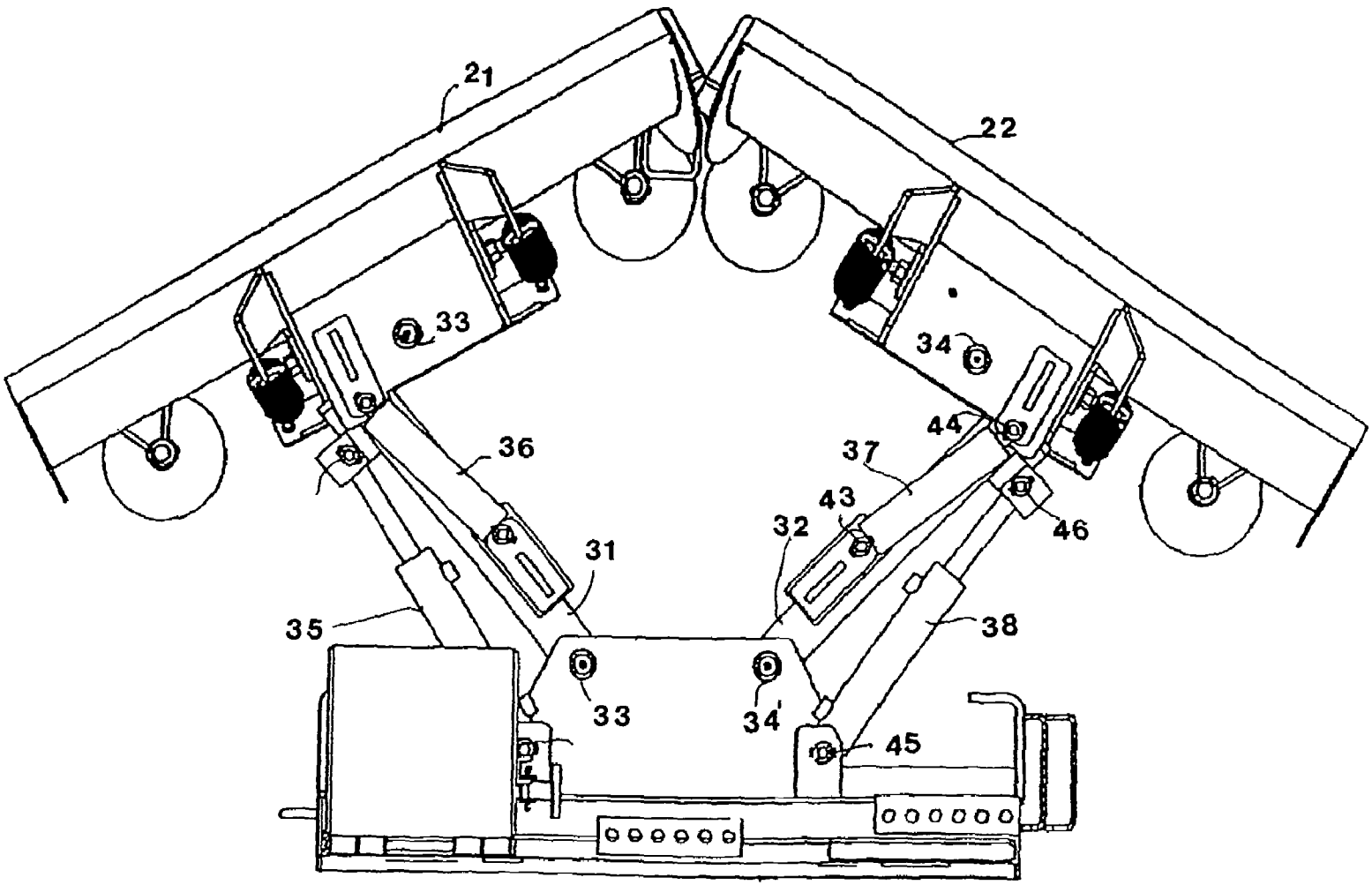
FIG. 8 is a top view with the blades closely adjacent one another in a forward V shape or configuration.

The blades 21 and 22 can be pivoted to the convex position with the forward ends of the blades closely adjacent one another as shown in FIG. 8 to be used for cutting a V-shaped path in the snow or dirt which operation is easier to perform than when the blades are in a straight line position with respect to one another.

Figure 9:
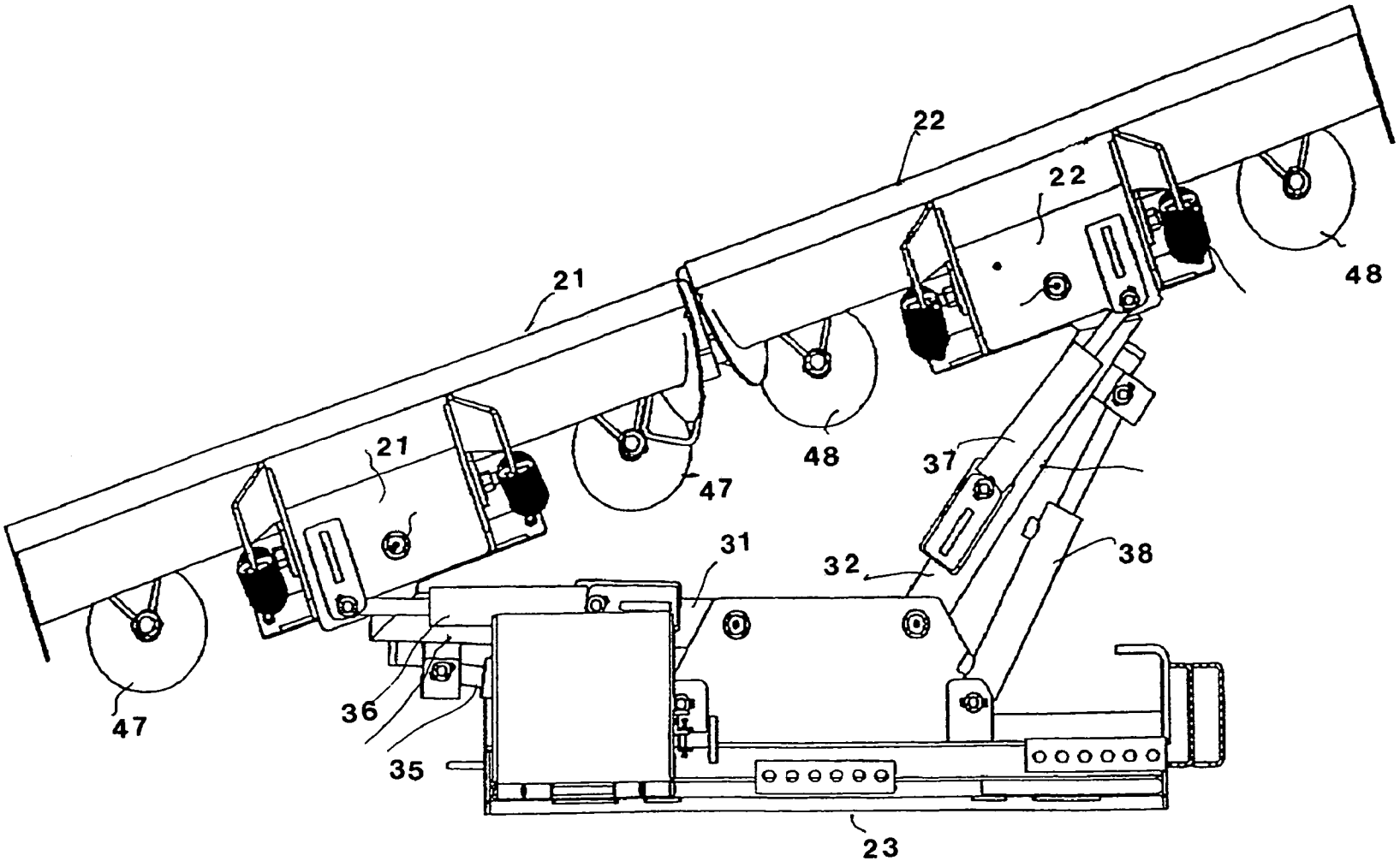
FIG. 9 illustrates the trench blade invention in a straight line to one another but at a right angle to the machine and its path to throw snow or dirt to the right side of the invention or machine.

The blades 21 and 22 can be pivoted to a straight line left angular position with respect to the back frame as shown in FIG. 9 to drive materials to the left side with respect to the blades.

Figure 10:
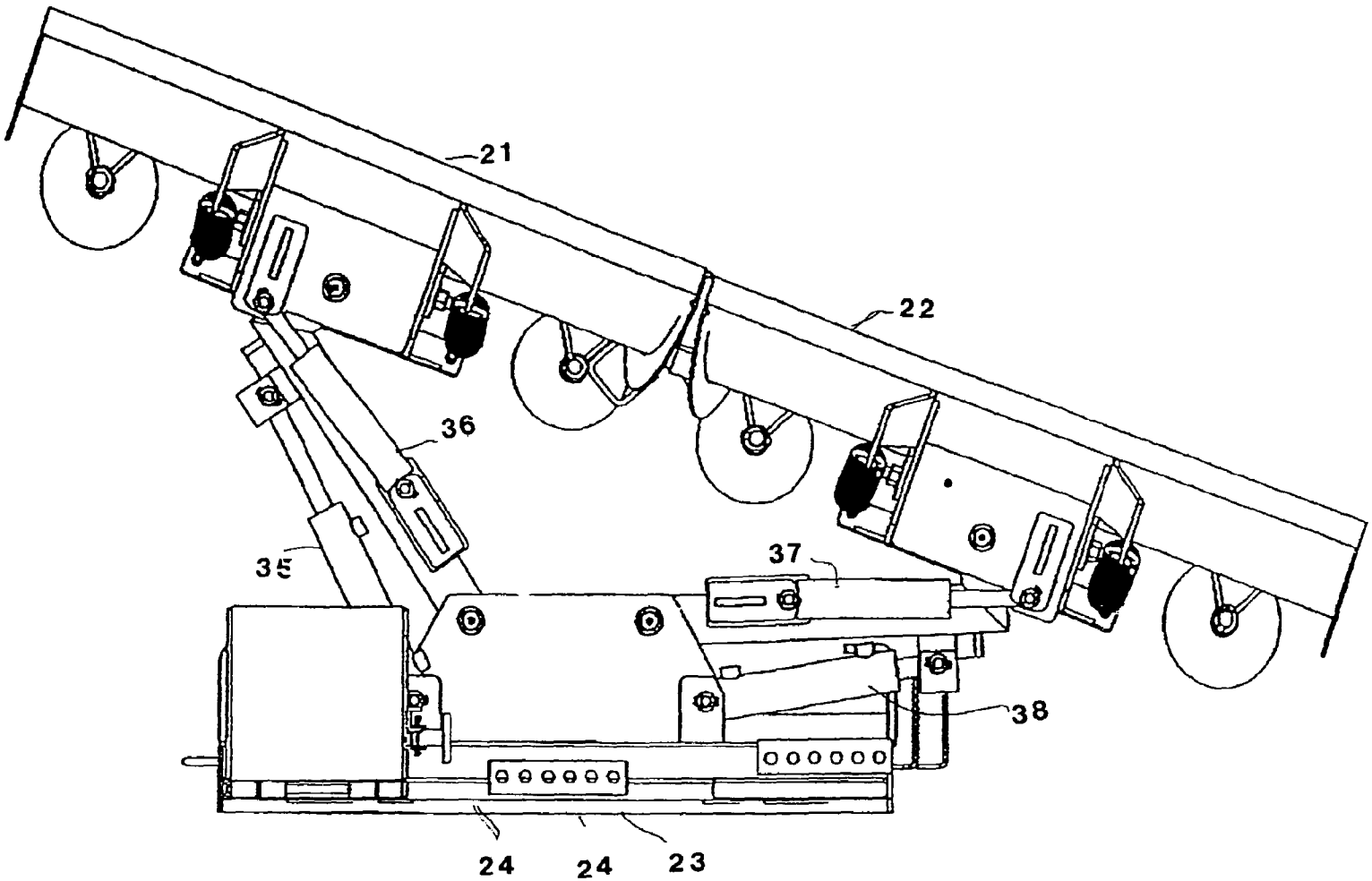
FIG. 10 illustrates the trench blade invention in a straight line to one another but at a left angle to the machine and its path to throw snow and dirt to the left side of the invention or machine.

The blades can be pivoted to a straight line right angular position as shown in FIG. 10 by operating the pistons and cylinders, when desired; as well as other positions.

The straight line blades 21 and 22 are long enough to form a path larger than the skid steer track which gives a maximum width or path which can be used for blading when a straight push is required in either snow or dirt. The blades when in the maximum width position can be pivoted into their left angle or right angle for throwing snow or dirt to the left or right side of the machine. another.

A pair of leveling discs 47 and 47' are mounted to the blade 21 and a similar pair of leveling discs 48 and 48' are mounted to the blade 22. The discs are adjustably mounted up or down to limit the distance between each blade and the ground the blades and loader are operating upon.

Thus the trench blade attachment 20 has many functions that make it a year around attachment It has the five individual functions and all are controlled hydraulically from inside the skid steer.

Its first feature is it has the forward V plow position as previously described and shown in FIGS. 1-5, inclusive for moving heavier material such as heavy snowdrifts.

Its second feature is the straight blade position as shown in FIG. 7.

Its third feature is its right angle position as shown in FIG. 10.

Its fourth feature is its left angle position as shown in FIG. 9.

Its fifth feature is its reverse V blade position as shown in FIG. 6.

The blades may also be positioned in various positions therebetween.

It will be obvious that various changes and departures may be made to the invention without departing from the spirit and scope thereof, and accordingly, it is not intended that the invention be limited to that specifically described in the specification or as illustrated in the drawings, but only as set forth in the appended claims wherein:

What is claimed is:

1. A trench blade apparatus for attachment to a front end loader comprising a main rear frame for attachment at the front of said loader, a left blade, a left forward frame in front of said main frame and behind said left blade, spring means connecting said left forward frame to said left blade, a left arm pivotally connecting said main frame to said left forward frame, a first left piston and cylinder pivotally connected at its rearward end to said left arm and its forward end pivotally connected to said left forward frame, a second left piston and cylinder having its one end pivotally connected to said rear main frame and its other end pivotally connected to said left arm;

a right blade, a right forward frame in front of said main frame and behind said right blade, spring means connecting said right forward frame to said right blade, a right arm pivotally connecting said main frame to said right forward frame, a first right piston and cylinder pivotally connected at its rearward end to said right arm and its forward end and pivotally connected at its forward end to said right forward frame, a second right piston and cylinder having its one end pivotally connected to said main frame and its other end pivotally connected to said right arm;

whereby the left and right forward frames may pivot the right and left blades to various angles on the left and right arms by the first left and right pistons and cylinders and the second left and right piston and cylinders may pivot the left and right arms and thereby the left and right blades to various additional angles and alignments.

2. A trench blade apparatus according to claim 1 wherein said left and right blades each have a pair of leveling discs at the bottoms of their left and right ends.

* * * * *